US005803937A

United States Patent [19]

Hartermann et al.

[11] Patent Number: 5,803,937

[45] Date of Patent: Sep. 8, 1998

[54] METHOD OF COOLING A DUST-LADEN RAW GAS FROM THE GASIFICATION OF A SOLID CARBON-CONTAINING FUEL

[75] Inventors: Ralf-Uwe Hartermann, Wiehl; Arno Hendricks, Gummersbach; Leszek Gawlowski, Reichshof-Wolfseifen; Hubert Scheid, Gummersbach, all of Germany

[73] Assignee: L. & C. Steinmuller GmbH, Gummersbach, Germany

[21] Appl. No.: 685,791

[22] Filed: Jul. 24, 1996

Related U.S. Application Data

[63] Continuation-in-part of Ser. No. 302,849, filed as PCT/EP94/00088 Jan. 13, 1994 published as WO94/16039 Jul. 21, 1994, abandoned.

[30] Foreign Application Priority Data

Jan. 14, 1993 [DE] Germany ..... 43 00 776.7

[51] Int. Cl.[6] ..... C10J 3/46

[52] U.S. Cl. ..... 48/210; 48/62 R; 48/73; 48/197 R

[58] Field of Search ..... 48/197 R, 62 R, 48/73, 206, 210

[56] References Cited

U.S. PATENT DOCUMENTS

| | | | |
|---|---|---|---|
| 2,594,329 | 4/1952 | Mayhew | 48/67 |
| 3,988,123 | 10/1976 | Coates | 48/77 |
| 4,314,826 | 2/1982 | Vollhardt | 122/392 |
| 4,328,007 | 5/1982 | Rafael | 122/390 |
| 4,372,253 | 2/1983 | Hibbel et al. | 122/7 R |
| 4,377,132 | 3/1983 | Koog et al. | 122/7 R |
| 4,478,608 | 10/1984 | Dörling et al. | 48/210 |
| 4,481,014 | 11/1984 | Dörling | 48/76 |
| 4,493,291 | 1/1985 | Zabelka | 48/67 |
| 4,513,694 | 4/1985 | Wiemer | 48/77 |
| 4,520,760 | 6/1985 | Covell | 48/77 |
| 4,671,806 | 6/1987 | Stil et al. | 48/DIG. 2 |
| 4,731,097 | 3/1988 | Köhnen et al. | 48/67 |
| 4,768,470 | 9/1988 | Ziegler | 48/67 |
| 4,859,214 | 8/1989 | Segerstrom et al. | 48/197 R |
| 4,936,871 | 6/1990 | Wilmer et al. | 48/197 R |
| 4,950,308 | 8/1990 | Lang et al. | 48/67 |
| 4,957,657 | 9/1990 | Stil et al. | 252/373 |
| 4,959,078 | 9/1990 | Ziegler | 48/77 |
| 5,011,507 | 4/1991 | Stil et al. | 48/62 R |
| 5,248,316 | 9/1993 | Peise et al. | 48/67 |
| 5,441,547 | 8/1995 | Durrfeld et al. | 48/197 R |
| 5,445,658 | 8/1995 | Durrfeld et al. | 48/76 |

FOREIGN PATENT DOCUMENTS

| | | | |
|---|---|---|---|
| 0115094 | 8/1984 | European Pat. Off. . | |
| 0375894 | 7/1990 | European Pat. Off. . | |
| 2500470 | 2/1982 | France . | |
| 2514023 | 9/1982 | France . | |
| 2513741 | 4/1993 | France | 48/67 |
| 1596323 | 4/1970 | Germany . | |
| 3809313 | 10/1989 | Germany . | |
| 2050585 | 1/1991 | United Kingdom . | |

*Primary Examiner*—Tae Yoon
*Attorney, Agent, or Firm*—Robert W Becker & Associates

[57] ABSTRACT

A process and system for cooling a dust-laden raw or untreated gas from the gasification of a solid carbon-containing fuel in a pressurized reactor. The gas from the reactor is introduced into a quench pipe that has a cross-sectional area that is smaller than the cross-sectional area of the reactor, and to which is supplied a quenching medium for direct cooling. The gas emerging from the outlet end of the quench pipe is deflected essentially by 180° and, counter to the flow of the gas in the quench pipe, is guided through a cooling section that surrounds the quench pipe and is incorporated in a water-steam circuit.

20 Claims, 3 Drawing Sheets

METHOD OF COOLING A DUST-LADEN RAW GAS FROM THE GASIFICATION OF A SOLID CARBON-CONTAINING FUEL

This application is a continuation-in-part, of application Ser. No. 08/302,849, filed as PCT/EP94/00088 Jan. 13, 1994 published as WO94/16039 Jul. 21, 1994, now abandoned.

BACKGROUND OF THE INVENTION

The invention relates to a method of cooling a dust-laden raw or untreated gas from the gasification of a solid carbon-containing fuel in a pressurized reactor, with the gas from the reactor being introduced into a quench section that is supplied with a quenching medium for a direct cooling, and then is introduced into a cooling section that is incorporated in a watersteam circuit, from which it is withdrawn. The quenching medium can be a quenching gas or a quenching liquid.

EP-0 115 094-A2 discloses a process of this type according to which within a pressure vessel, by means of the lower portion of a diaphragm wall of the gasification reactor that extends along the vessel, there are defined the quench section that is disposed above the reactor, a radiation chamber, and a cooling section that is defined by a heat transfer surface. The reactor, the quench section, and the cooling section have the same cross-sectional area. After leaving the upper end of the pressure vessel, the dust-laden raw gas is withdrawn accompanied by deflection by 90° and is conveyed to a cyclone. The hot gas that leaves the cyclone is conveyed to a further pressure vessel in which is disposed a further heat transfer surface.

A water bath is disposed below the outlet of the reactor for liquid slag. By maintaining the cross-sectional area of the reactor in the region of the quench portion and the radiation portion, the convective heat transfer in these regions cannot contribute much to cooling the gas.

It is therefore an object of the present invention to provide a method according to which already after supply of the quenching medium, the contribution of convective and/or radiant heat transfer toward the cooling is improved.

SUMMARY OF THE INVENTION

This object is realized in that the gas from the reactor is passed into a quench pipe that has a cross-sectional area that is smaller than the cross-sectional area of the reactor, in that the gas issuing from the discharge end of the quench pipe is deflected essentially by 180°, and in that the gas is guided through a cooling section that surrounds the quench pipe in a countercurrent flow, i.e., in a direction that is opposite to the direction of flow of the gas in the quench pipe.

By reducing the diameter of the quench section, the contribution of the convective and/or radiant heat transfer in the quench section is increased. By reducing the cross-sectional area of the quench section, there is also obtained the advantage of being able to guide the gas that issues from the quench pipe in a countercurrent flow along the outer surface of the quench pipe. In so doing, the overall length of the unit required for carrying out the process is considerably reduced.

A withdrawal of the gas from the cooling section is advantageously accompanied by deflection.

For the inventive operational sequence, it is advantageous if additional heat is withdrawn by thermal radiation from the gas during the deflection into the downstream cooling section.

U.S. Pat. No. 4 859 214 discloses a gasification reactor that is disposed in a pressure vessel and the upper end of which is connected to a reduced diameter quench pipe. However, with this known unit the quench pipe is not surrounded by a heat transfer surface and no 180° deflection occurs into one and the same pressure vessel.

The present invention is also directed to a hot gas cooling system of a unit for the gasification of a solid carbon-containing fuel in a pressurized reactor and having a pressure vessel for accommodating the reactor, a quenching chamber that is connected to the outlet of the reactor and is supplied with a quenching medium, and a cooling mechanism that is connected to the gas outlet side of the quenching chamber and includes at least one heat transfer surface, as is known from EP-0 115 04 A2, and is incorporated in a water-steam circuit and is disposed in the pressure vessel.

To improve the heat transfer and to reduce the capital investment, the unit is inventively characterized in that the quenching chamber is a quench pipe having a cross-sectional area that is smaller than the cross-sectional area of the reactor, in that at the discharge end of the quench pipe there is disposed a deflection chamber for the 180° deflection of the stream of gas that issues from the quench pipe, and in that the quench pipe is annularly surrounded by at least one group of heat transfer surface means along a prescribed length thereof, with the deflected stream of gas flowing through the heat transfer surface means, and in that at the discharge end of the heat transfer surface means, there is provided a gas collection chamber that communicates with at least one gas withdrawal conduit that extends through the wall of the pressure vessel.

In contrast to the unit known from EP 0 115 094 the overall length is considerably reduced, and relative to the unit known from U.S. Pat. No. 4 859 214 it is even possible to eliminate the second container for receiving the convective heat transfer surface means.

If the outwardly disposed boundary surface of the heat transfer surface means is freely exposed relative to the inner wall of the pressure vessel, it is advantageous to line the inner wall at least in the region of the heat transfer surface means. However, it is also possible to dispose the heat transfer surface means in an annular chamber that is defined toward the inside by the quench pipe and toward the outside by an outer cooling wall that is spaced from the inner wall of the pressure vessel. Just like the quench section of the arrangement of EP 0 115 094, the quench pipe is preferably also embodied as a cooling wall.

In both cases it is advantageous if the outer diameter of the cooling wall or heat transfer surface means corresponds approximately to the outer diameter of the reactor, so that there still remains a passable space in the direction of the inner wall of the pressure vessel.

It is furthermore expedient if the deflection chamber is embodied as a radiation chamber.

It is also expedient for the base of the gas collection chamber to be inclined relative to the longitudinal axis of the quench pipe to facilitate the withdrawal of the gas, which is dust-laden or contains solid material, from the gas collection chamber and in order to avoid possible erosion problems that might occur.

A particularly advantageous embodiment of the base of the gas collection chamber is achieved if the base of the gas collection chamber has a portion that surrounds the quench pipe at a distance therefrom, with the free end of this portion being disposed in an airtight manner against the outer wall of the quench pipe. This can be achieved via a compensator or in the manner of a stuffing-box. The portion that surrounds the quench pipe can either face the heat transfer means or be directed away therefrom. This makes it easier to take into consideration problems of varying thermal expansion.

It is expedient for the gas withdrawal conduit that communicates with the gas collection chamber to extend through the wall of the pressure vessel a t an angle of inclination relative to the axis of the quench pipe.

It is also advantageous if the base of the gas collection chamber and/or the gas withdrawal conduit is insulated.

The heat transfer surface means can comprise a plurality of bundles, which each preferably comprise individual cylinders of wound or coiled tubes.

These cylinders can have varying lengths.

As with the state of the art, the pressure vessel is preferably vertically disposed. The gasification reactor is disposed in the lower portion of the pressure vessel, with the quench pipe and the heat transfer surface means being disposed thereabove. In such a case, it is preferable pursuant to the present invention that the base of the gas collection chamber, and the gas withdrawal conduit, be inclined in the same direction.

However, it is also conceivable that for a vertically disposed pressure vessel, the reactor be disposed in the upper portion of the pressure vessel and the gas be withdrawn from the lower end of the downwardly projecting quench pipe, so that the deflection is effected in the lower end of the pressure vessel.

BRIEF DESCRIPTION OF DRAWING

The inventive method and two exemplary embodiments of the inventive system are described in detail in conjunction with the accompanying drawings, in which.

DESCRIPTION OF PREFERRED EMBODIMENTS

Disposed in the lower portion of a vertically positioned pressure vessel 1 having a removable lid 2 is a reactor 3, the walls of which are incorporated in a water-steam circuit WDK. Associated with the reactor are burners 4 for the partial combustion of coal dust with an oxygen containing gas.

Figure 1:
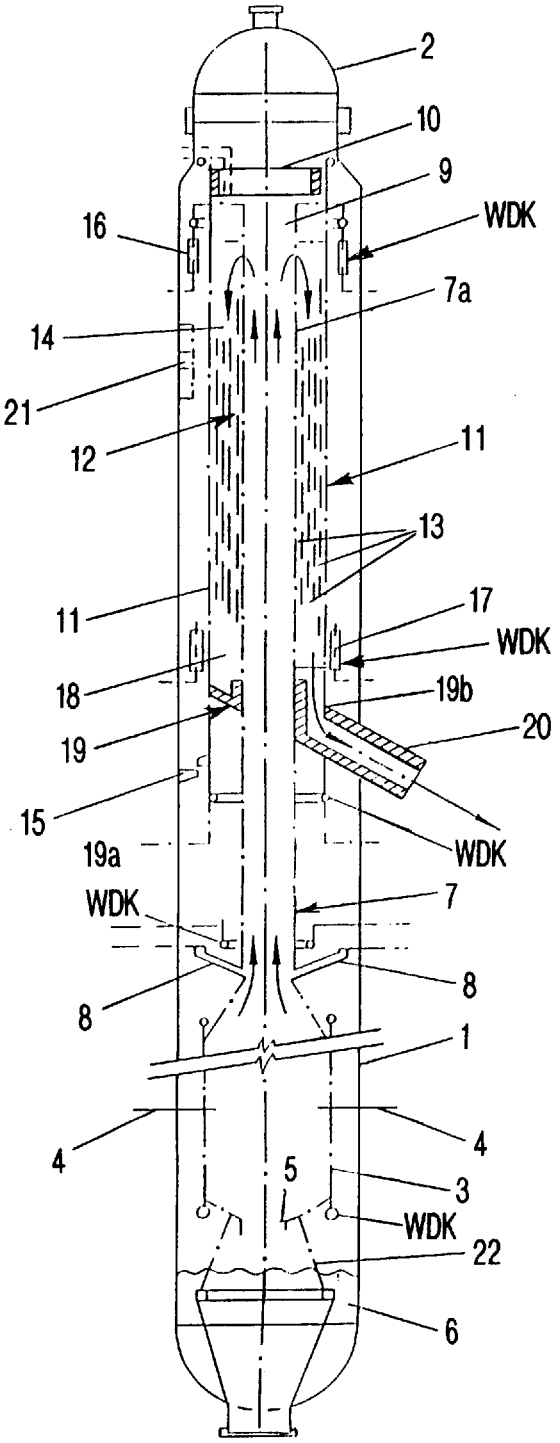
FIG. 1 is a schematic vertical section through one exemplary embodiment of an inventive system, with the reactor being disposed in the lower portion of the vertically positioned pressure vessel.
Figure 1A:
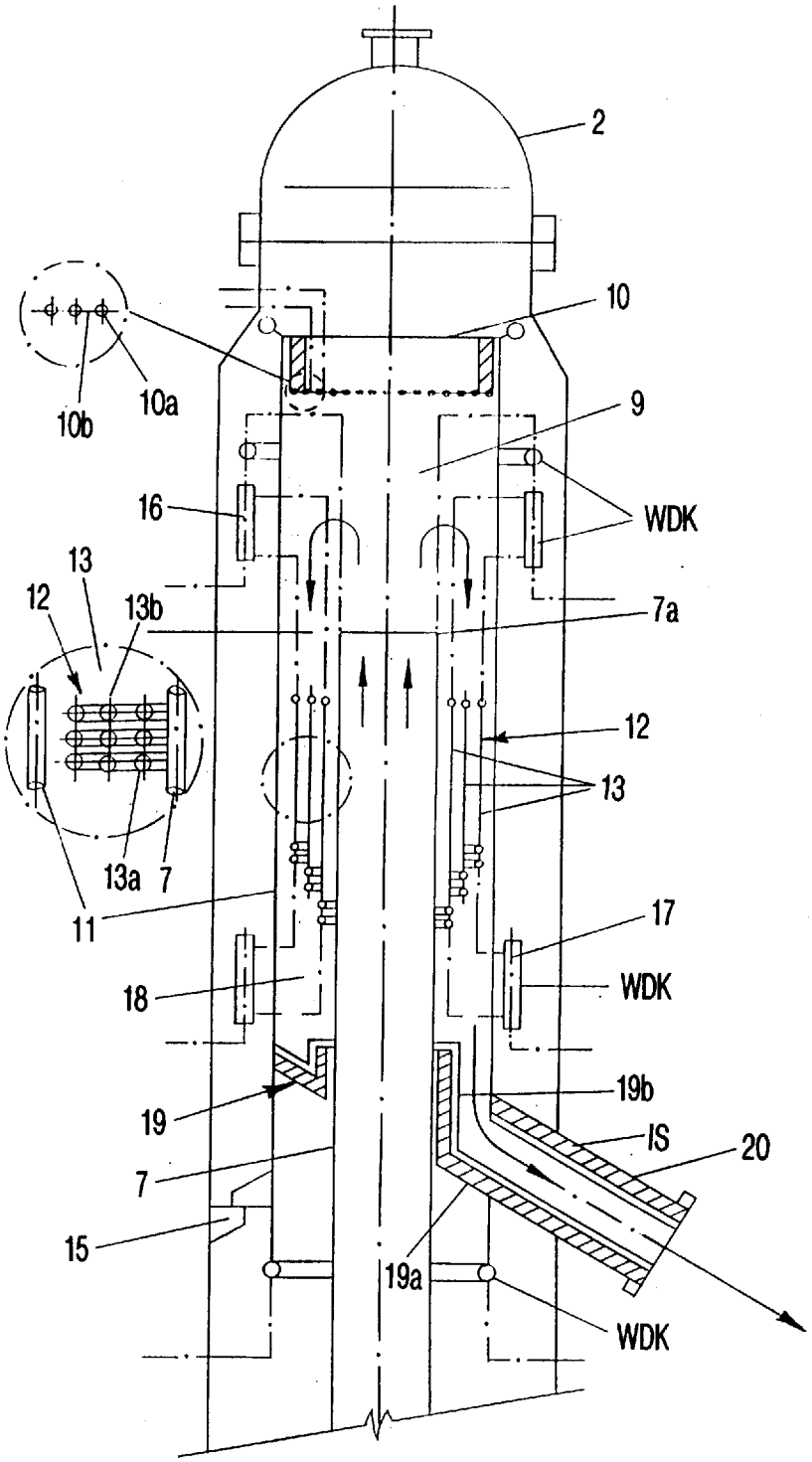
FIG. 1*a* is an enlarged partial view of the system of FIG. 1 showing details of an exemplary cooled surface for the deflection chamber, of exemplary heat transfer surface means in the annular chamber between the quench pipe and the cooling wall, and of an exemplary insulated gas withdrawal conduit.
Figure 2:
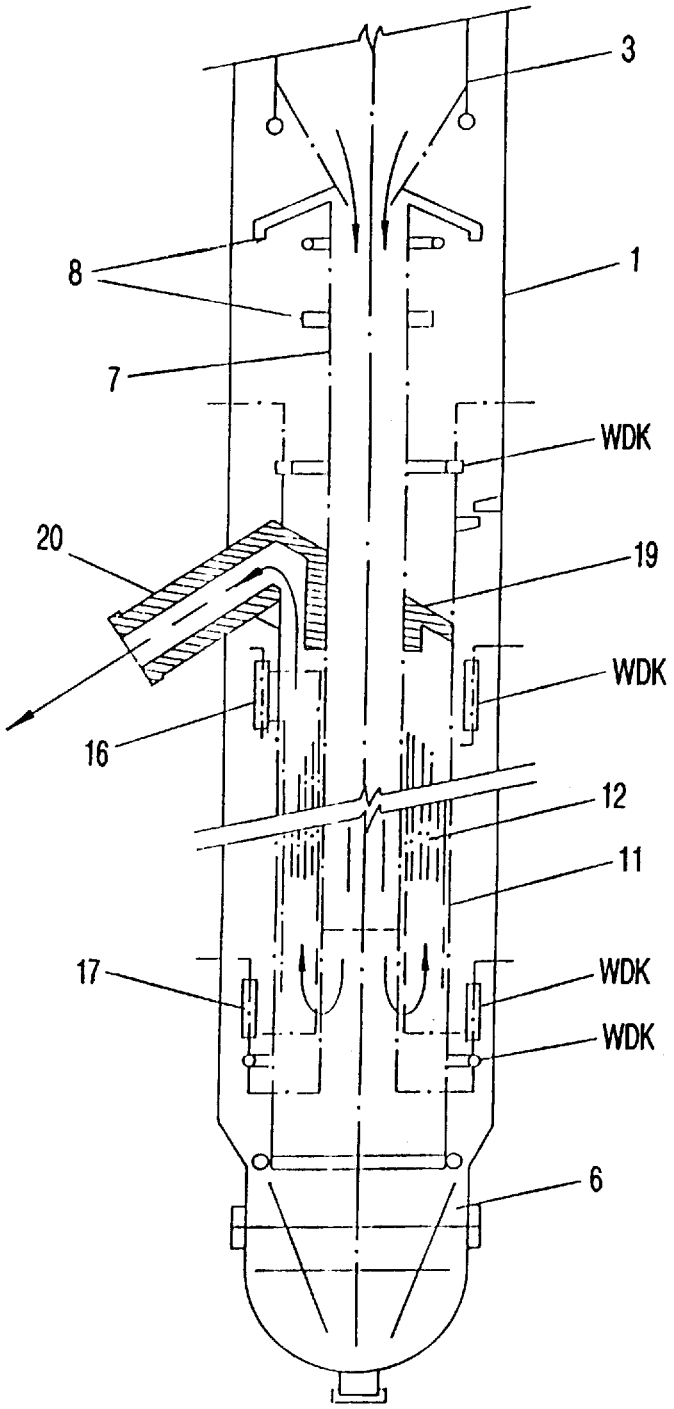
FIG. 2 is a partial section of an exemplary embodiment where the reactor is disposed in the upper portion of the pressure vessel.

The bottom end of the reactor 3 is provided with a slag discharge opening 5 that opens out toward a water bath 6 that is disposed in the lower portion of the pressure vessel. The upper end of the reactor 3 narrows in a conical fashion and is connected to a quench tube or pipe 7 that has a smaller diameter than does the reactor 3 and that is embodied as a cooling wall (see, for example, the enlarged portion to the left of the middle of FIG. 1*a*, which indicates that the quench pipe 7, as well as the later to be discussed cooling wall 11, can be composed of tubes). A quenching medium is supplied in the connection region between the reactor 3 and the quench pipe 7 via conduits 8. Water, steam and/or cooled return gas are suitable for this purpose. The upper end 7*a* of the quench pipe 7 opens out to a deflection chamber 9, the upper end of which is closed off by a cooled surface or head 10, and the walls of which are delimited by a cooling wall 11 that extends coaxially relative to the quench pipe. By way of example, as shown in the encircled area of FIG. 1*a*, the cooled surface or head 10, on that side that faces the upper end 7*a* of the quench pipe 7, can be in the form of a plate that has a tube 10*a*/fin 10*b* construction. The cooling wall extends downwardly to a given distance and, just like the quench pipe 7, is incorporated in the water-steam circuit WDK. Disposed in the annular chamber defined by the quench pipe 7 and the cooling wall 11 is a group of heat transfer surface means 12 comprised of a plurality of cylinders 13 that are disposed coaxially relative to one another and are coiled from tubes. The cylinders 13 have varying axial lengths. The inwardly disposed cylinders are longer than the outwardly disposed cylinders. It is to be understood that other constructions could also be used for the heat transfer surface means 12. However, FIG. 1*a* shows one exemplary embodiment of the heat transfer surface means 12 that are disposed in the annular chamber formed between the cylindrical cooling wall 11 and the cylindrical quench pipe 7. In this exemplary embodiment, rather than five cylinders 13 as illustrated in FIGS. 1 and 2, here only three coaxially disposed cylinders 13 are illustrated. In particular, it can be seen that the cylinders 13 of FIG. 1*a* are not merely coiled tubes, but rather are comprised of tubes 13*a* and fins 13*b*, so that it can be seen that these cylinders have a tube/fin/tube construction. The cooling wall or jacket 11, possibly with the interposition of other components, is supported on the pressure vessel 1 via support means 15. For the supply of the heat transfer surface means 12, the water-steam circuit WDK has upper and lower collectors 16 and 17.

Disposed below the lower end of the heat transfer surface means 12 is a gas collection chamber 18 having a base 19. The base 19 comprises an inclined base plate 19*a* and a cylindrical portion 19*b* that projects into the gas collection chamber and is spaced from the wall of the quench pipe, with only its free end being connected in an air tight manner to the wall of the quench pipe (see FIG. 1*a*). To withdraw the gas that accumulates in the gas collection chamber, a gas withdrawal conduit 20 is provided that communicates with the gas collection chamber and passes downwardly at an angle through the wall of the pressure vessel 1. With the embodiment illustrated in FIG. 1, where the quench pipe 7 and the heat transfer surface means 12 are disposed above the reactor 3, it is preferred that not only the base plate 19*a* but also the gas withdrawal conduit 20 be slanted downwardly at the same angle of inclination. As can furthermore be seen from FIG. 1*a*, both the base 19 and the gas withdrawal conduit 20 can be provided with insulation IS.

It is also conceivable to entirely or partially eliminate a separate outer cooling wall 11 that extends in the axial direction of the heat transfer means and to use the inner wall of the pressure vessel 1 itself to delimit the flow path. In this case, the base plate 19*a* must extend all the way to the wall of the pressure vessel. As illustrated on the left side of FIG. 1 near the top, it is then advantageous for the pressure vessel to be provided with a lining 21, such as a brick lining, in this region.

In the embodiment illustrated in FIG. 2, the same reference symbols have to the most extent been used. With the arrangement of FIG. 2, the reactor 3 is disposed in the upper portion of the pressure vessel 1 and the quench tube or pipe 7 extends downwardly. Just like the conical slag guide 22 that is illustrated in FIG. 1 but has not yet been described, in the embodiment of FIG. 2 the outer cooling jacket or wall 11 extends into the water bath 6.

In addition to these deviations, in the embodiment of FIG. 2 although the base plate 19*a* of the base for closing off the gas collection chamber 18, and the gas withdrawal conduit 20, are both inclined downwardly, they are inclined in opposite directions.

With both embodiments, the gas is first produced in a pressure vessel 1 in a reactor 3 from solid fuels, at temperatures above the slag softening point, by gasification of the fuel under pressure. To cool the raw or untreated gas, which is laden with both fluid and solid particles, the following cooling means are effective in one and the same pressure vessel in the sequence indicated:

First of all, in the quench pipe 7 with its smaller diameter than the diameter of the reactor 3, there is effected a direct cooling together with a predominantly indirect cooling by convective and/or radiant heat transfer and in particular preferably to a gas temperature below the slag softening temperature.

A further indirect cooling via thermal radiation is then effected in the deflection chamber 9, which is embodied as a radiation chamber. After the deflection, a further indirect cooling is effected by heat exchange via the heat transfer surface means 12 that are disposed downstream to the temperature level desired at the discharge 20. The heat transfer surface means 12 can be a radiation and/or a convection heat transfer surface means. In the extreme case, it would also be possible to achieve a true radiant heat transfer just with the wall heat transfer surfaces that surround the quench pipe. However, a heat transfer surface means having a high fraction of convection is preferred; even more preferred is a heat transfer surface means that is essentially only convective.

The present invention is, of course, in no way restricted to the specific disclosure of the specification and drawings, but also encompasses any modifications within the scope of the appended claims.

What we claim is:

1. A method of cooling a dust-laden raw gas from the gasification of a solid carbon-containing fuel in a pressurized reactor that is disposed in a pressure vessel, said method including the steps of:

introducing said gas from said reactor into a quench pipe that is disposed in said pressure vessel and has a cross-sectional area that is smaller than a cross-sectional area of said reactor;

supplying a quenching medium to said quench pipe for direct cooling of said gas;

deflecting gas that issues from a discharge end of said quench pipe by essentially 180°;

subsequently guiding said deflected gas into a first end of an annular chamber formed within said pressure vessel between said quench pipe and a wall of said pressure vessel, said annular chamber containing an elongated cooling heat transfer surface means that surrounds said quench pipe and is incorporated in a water-steam circuit, said gas being guided in said annular chamber and about said cooling heat transfer surface means in a direction of flow countercurrent to the direction of flow of gas in said quench pipe; and withdrawing said gas from a second end of said annular chamber that is remote from said first end thereof.

2. A method according to claim 1, wherein said step of withdrawing said gas from said cooling section is accompanied by deflection thereof.

3. A method according to claim 2, which includes the step of withdrawing additional heat from said gas, via thermal radiation, during said step of deflecting gas that issues from a discharge end of said quench pipe.

4. A hot gas cooling system in a unit for the gasification of a solid carbon-containing fuel in a pressurized reactor, said system comprising:

a pressure vessel in which said reactor is disposed;

a quenching chamber within said pressure vessel that communicates with an output side of said reactor for receiving gas therefrom, said quenching chamber being provided with conduit means for being supplied with a quenching medium for direct cooling of said gas, said quenching chamber being in the form of a quench pipe that has a smaller cross-sectional area than does said reactor;

a deflection chamber disposed at a discharge end of said quench pipe for deflecting a stream of gas issuing from said quench pipe by 180°;

an annular chamber formed within said pressure vessel between said quench pipe and wall means of said pressure vessel;

at least one discrete heat transfer surface means disposed in said annular chamber and annularly surrounding a given length of said quench pipe for receiving said deflected stream of gas at an entrance end of said annular chamber and passing said gas stream to a discharge end of said annular chamber, about said heat transfer surface means, in a direction countercurrent to a direction of flow of said gas stream through said quench pipe;

a gas collection chamber provided in said pressure vessel at said discharge end of said annular chamber; and and at least one gas withdrawal conduit that communicates with said gas collection chamber and extends outwardly through said wall means of said pressure vessel.

5. A hot gas cooling system according to claim 4, wherein an outwardly disposed boundary surface of said heat transfer surface means is freely exposed relative to an inner wall of said pressure vessel, and wherein said inner wall of said pressure vessel is provided with lining means at least in the region of said heat transfer surface means.

6. A hot gas cooling system according to claim 4, which includes an outer cooling wall that is spaced inwardly from an inner wall of said pressure vessel, with said annular chamber being formed between said quench pipe toward the inside and said cooling wall toward the outside.

7. A hot gas cooling system according to claim 6, wherein said quench pipe is a cooling wall comprising cooling means.

8. A hot gas cooling system according to claim 6, wherein one of said cooling wall or said heat transfer surface means has an outer diameter that corresponds to the outer diameter of said reactor and is less than the inner diameter of said pressure vessel, whereby a passable space remains relative to said inner wall of said pressure vessel.

9. A hot gas cooling system according to claim 8, wherein said deflection chamber is a radiation chamber having means for withdrawing heat from said gas stream during deflection thereof.

10. A hot gas cooling system according to claim 6, wherein said gas collection chamber is provided with a base that is inclined relative to a longitudinal axis of said quench pipe.

11. A hot gas cooling system according to claim 10, wherein said base of said gas collection chamber is provided with a portion that surrounds and is spaced from said quench pipe, with said portion of said base having an end that is sealed in an airtight manner against an outer wall of said quench pipe.

12. A hot gas cooling system according to claim 11, wherein said gas withdrawal conduit that communicates with said gas collection chamber extends through said wall means of said pressure vessel at an inclined angle relative to said longitudinal axis of said quench pipe.

13. A hot gas cooling system according to claim 10, wherein said pressure vessel is positioned vertically, said gasification reactor is disposed in a lower portion of said pressure vessel, said quench pipe and said heat transfer surface means are disposed above said reactor, and said base of said gas collection chamber and said gas withdrawal conduit are inclined in the same direction.

14. A hot gas cooling system according to claim 10, wherein said pressure vessel is positioned vertically, said reactor is disposed in an upper portion of said pressure vessel, gas is withdrawn from a lower end of a downwardly projecting quench pipe, and said deflection chamber is disposed at a lower end of said pressure vessel.

15. A hot gas cooling system according to claim 14, wherein said base of said gas collection chamber and said gas withdrawal conduit are inclined in opposite directions.

16. A hot gas cooling system according to claim 4, wherein said at least one heat transfer surface means disposed in said annular chamber is a group of heat transfer surface means comprised of a plurality of cylinders that are disposed coaxially relative to one another.

17. A hot gas cooling system according to claim 16, wherein said cylinders respectively have a tube/fin/tube construction.

18. A hot gas cooling system according to claim 16, wherein said cylinders are each formed by coiled tubes.

19. A hot gas cooling system according to claim 4, wherein at least one of said base of said collection chamber and said gas withdrawal conduit are insulated.

20. A method of cooling a dust-laden raw gas from the gasification of a solid carbon-containing fuel in a pressurized reactor that is disposed in a pressure vessel, said method including the steps of:

a) providing a gasification reactor having means for gasifying said fuel under pressure to form a crude gas laden with fluid and solid particles, a quench pipe positioned concentrically to the gasification reactor and having a cross-sectional area that is smaller than a cross-sectional area of said reactor, a convection-heated heat transfer surface means concentrically surrounding the quench pipe, the convection-heated heat transfer surface means having a gas outlet device, and a gas flow deflection device spaced from the quench pipe, the gas flow deflection device being rotationally symmetric with respect to a longitudinal axis of the quench pipe and connecting the quench pipe and the convection-heated heat transfer surface means;

b) conducting the crude gas and the particles produced during the gasifying from the gasification reactor into the quench pipe;

c) feeding a quenching medium into the quench pipe during the gasifying to form a mixed flow, said mixed flow comprising said crude gas, said particles and said quenching medium;

d) guiding said mixed flow about a 180° turn by said gas flow deflection device;

e) conducting the mixed flow into the convection-heated heat transfer surface means from the gas flow deflection device;

f) feeding said mixed flow from said heat transfer surface means with the help of the gas outlet device; and g) adjusting a gas flow speed of said mixed flow so that said particles travelling in said mixed flow in said heat transfer surface means experience a cooling in said heat transfer surface means so that said particles lose adherence ability and are conducted through said gas outlet device from said convection-heated heat transfer surface means.

* * * * *